US008183976B2

(12) United States Patent
Lo et al.

(10) Patent No.: US 8,183,976 B2
(45) Date of Patent: May 22, 2012

(54) RESISTOR DEVICE AND METHOD FOR MANUFACTURING SAME

(75) Inventors: Ta-Wen Lo, Hsinchu (TW); Wen-Hsiung Liao, Hsinchu (TW); Wu-Liang Chu, Miaoli County (TW); Yen-Ting Lin, Hsinchu (TW)

(73) Assignee: Cyntec Co., Ltd., Hsinchu (TW)

( * ) Notice: Subject to any disclaimer, the term of this patent is extended or adjusted under 35 U.S.C. 154(b) by 158 days.

(21) Appl. No.: 12/779,656

(22) Filed: May 13, 2010

(65) Prior Publication Data

US 2011/0063072 A1 Mar. 17, 2011

(30) Foreign Application Priority Data

Sep. 17, 2009 (TW) ..... 98131424 A

(51) Int. Cl.
*H01C 1/012* (2006.01)

(52) U.S. Cl. ..... 338/314; 338/20; 338/309; 338/320

(58) Field of Classification Search ..... 338/20, 338/309, 314, 320, 328, 330, 332
See application file for complete search history.

(56) References Cited

U.S. PATENT DOCUMENTS

| | | | | |
|---|---|---|---|---|
| 4,486,738 | A * | 12/1984 | Sadlo et al. | 338/320 |
| 5,287,083 | A | 2/1994 | Person et al. | |
| 6,005,474 | A * | 12/1999 | Takeuchi et al. | 338/320 |
| 6,469,614 | B2 * | 10/2002 | Muziol et al. | 338/309 |
| 6,794,985 | B2 | 9/2004 | Nakamura et al. | |
| RE39,660 | E | 5/2007 | Szwarc et al. | |
| 2011/0063072 | A1 * | 3/2011 | Lo et al. | 338/314 |

* cited by examiner

*Primary Examiner* — James Harvey
(74) *Attorney, Agent, or Firm* — Kirton McConkie; Evan R. Witt

(57) ABSTRACT

A resistor device includes a resistor plate having a first aperture, a second aperture, a third aperture and a fourth aperture respectively arranged on a first side, a second side, a third side and a fourth side thereof. A first electrode plate is coupled to the first side of the resistor plate and includes a first measurement zone and a second measurement zone disposed at opposite sides of the first aperture; and a second electrode plate is coupled to the third side of the resistor plate and including a third measurement zone and a fourth measurement zone disposed at opposite sides of the third aperture, wherein the first measurement zone and the third measurement zone are disposed at opposite sides of the second aperture, and the second measurement zone and the fourth measurement zone are disposed at opposite sides of the fourth aperture.

21 Claims, 8 Drawing Sheets

RESISTOR DEVICE AND METHOD FOR MANUFACTURING SAME

FIELD OF THE INVENTION

The present invention relates to a resistor device and a manufacturing method of the resistor device, and more particularly to a resistor device adapted to current sensing and a manufacturing method of the resistor device adapted to current sensing.

BACKGROUND OF THE INVENTION

A current sensing resistor, when serially connected to a load and applied current thereto, results in a voltage drop which may be measured and referred to estimate the current intensity. Since the resistance of a current sensing resistor is generally at a milliohm (mOhm) order, high resistance precision, e.g. with deviation within ±1%, is required compared to a common resistor. Accordingly, proper adjustment is generally performed in the manufacturing process of the current sensing resistor after measuring resistance of the newly produced resistor and calculating deviation of the measured resistance from a preset ideal value. Repetitive measurement and adjustment are performed until the measured resistance is close enough to the preset ideal value.

Conventionally, Kelvin measurement, which is a four-point type of measurement, is adopted to measure resistance of a current sensing resistor. The principle will be described hereinafter.

Please refer to FIG. 1, which schematically illustrates circuitry associated with Kelvin measurement. As shown, two ends of a resistor 15 whose resistance R is to be measured are respectively connected to four points 11, 12, 13 and 14. The points 13 and 14 are further respectively connected to head and tail ends of a constant current source 16 which supplies a constant current intensity I. On the other hand, the points 11 and 12 are coupled to respective probes with high impedance for measuring voltage difference therebetween. Since the input impedance of the probes coupled to the points 11 and 12 is relative high, it is assumed that no current would pass through point 11, resistor 15 and point 12, i.e. $i_1=0$, $i_2=0$. Under this circumstance, the constant current source 16, point 14, resistor 15 and point 13 form a circuit loop, and the voltage difference V between the points 11 and 12, where $V=V_{11}-V_{12}$, can be measured and used for calculating resistance of the resistor 15 based on Ohm's Law, i.e. V=IR.

FIG. 2A illustrates a structure of a conventional current sensing resistor as described in U.S. patent application Ser. No. RE39,660E, which is incorporated herein for reference. The current sensing resistor 100 includes a resistor plate 120 and two electrode plates 110 and 130 respectively welded to opposite sides of the resistor plate 120 and having apertures 140 and 150. On the electrode plates, sensing pads 111 and 113 and current pads 112 and 132 are defined as measuring area. When producing the current sensing resistor 100, a constant current I is applied between the current pads 112 and 132, and a voltage difference rendered between the sensing pads 111 and 131 ($V_{diff}=V_{111}-V_{131}$) when the constant current I passes through the current sensing resistor 100 is measured. Accordingly, resistance R1 of the resistor 120 can be calculated as $R1=V_{diff}/I$.

Please refer to FIG. 2B, which illustrates four measurement points defined in a measuring apparatus for measuring resistance of a newly produced resistor. The four measurement points 211, 212, 213 and 214 are arranged as a rectangle, wherein the measurement points 213 and 214 are associated with constant current input and the measurement points 211 and 212 are associated with output voltage measurement. The four measurement points 211, 212, 213 and 214 are substantially a constant distance from a resistor to be measured.

If measurement is conducted before a resistor belt is physically divided into resistor plates, the measurement points may be inconsistent for different plates due to mechanical deviation. For example, as shown in FIG. 2C and FIG. 2D, it may occur that the four measurement points are located at positions 311, 312, 313 and 314 (FIG. 2C) on a plate but located at different relative positions 311*a*, 312*a*, 313*a* and 314*a* on another plate (FIG. 2D).

Aside from, even if measurement is conducted twice for the same plate, deviation may also occur. For example, the four measurement points are located at positions 411, 412, 413 and 414 on the plate this time but located at different relative positions 411*a*, 412*a*, 413*a* and 414*a* on the plate next time, as illustrated in FIG. 2E. Assume a resistor 400 with desired resistance R is to be produced. During the production of the resistor 400, first measurement is performed and the four measurement points are located at the positions 411, 412, 413 and 414 on the plate so as to acquire a first resistance R1. If the first resistance R1 is not close to the desired R to a required extent, the different R-R1 needs to be offset and then second measurement is performed. Generally, it is expected that the second measurement would render a resistance closer to the desired resistance R than the first resistance R1. However, if the second measurement is performed at different relative positions 411*a*, 412*a*, 413*a* and 414*a* on the plate 400, the first measurement becomes non-referable for the improvement of the second measurement. Instead, a second resistance R2 which is still not close enough to the desired resistance R may be acquired. Such a mechanic misalignment problem occurring in the automation process is thus detrimental to Kelvin measurement. It is critical to minimize such deviation resulting from misalignment.

SUMMARY OF THE INVENTION

The present invention provides a resistor device, which includes: a resistor plate having a first aperture, a second aperture, a third aperture and a fourth aperture respectively arranged on a first side, a second side, a third side and a fourth side thereof; a first electrode plate coupled to the first side of the resistor plate and including a first measurement zone and a second measurement zone disposed at opposite sides of the first aperture; and a second electrode plate coupled to the third side of the resistor plate and including a third measurement zone and a fourth measurement zone disposed at opposite sides of the third aperture, wherein the first measurement zone and the third measurement zone are disposed at opposite sides of the second aperture, and the second measurement zone and the fourth measurement zone are disposed at opposite sides of the fourth aperture.

By providing the resistor device with the four measurement zones which are divided by the four apertures, the misalignment problem can be ameliorated so as to enhance resistance accuracy of the current sensing resistor.

In an embodiment, the resistor plate and the electrode plates form a stacked structure.

By providing the resistor device with the stacked structure of the electrodes and the resistor plates, the supporting strength of the resistor device can be enhanced.

The present invention further provides a manufacturing method of a resistor device, which includes: providing a resistor plate; creating a plurality of columns of apertures and a plurality of rows of apertures in the resistor plate; applying an electrode material onto the resistor plate to form a stacked structure; and dividing the stacked structure into a plurality of resistor units along the columns of apertures and the rows of apertures, each resistor unit having a first aperture, a second aperture, a third aperture and a fourth aperture on a first side, a second side, a third side and a fourth side thereof, respectively, for defining four measurement zones in the resistor unit, wherein the columns of apertures are divided into the first and third apertures, and the rows of apertures are divided into the second and fourth apertures.

In an embodiment, a slit is optionally created inside the fourth aperture for fine-tuning resistance of the resistor device.

With the use of the slit, the modification of the resistor plate for tuning the resistance can be easily done.

BRIEF DESCRIPTION OF THE DRAWINGS

The above contents of the present invention will become more readily apparent to those ordinarily skilled in the art after reviewing the following detailed description and accompanying drawings, in which.

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only; it is not intended to be exhaustive or to be limited to the precise form disclosed.

In order to ameliorate the measuring defects occurring in prior art, means for enhancing measuring reliability for a current sensing resistor is developed in the present invention. The present invention can be applied to a variety of manufacturing processes of current sensing resistors. The features of the present invention and then the applications of the present invention will be illustrated hereinafter.

Figure 1:
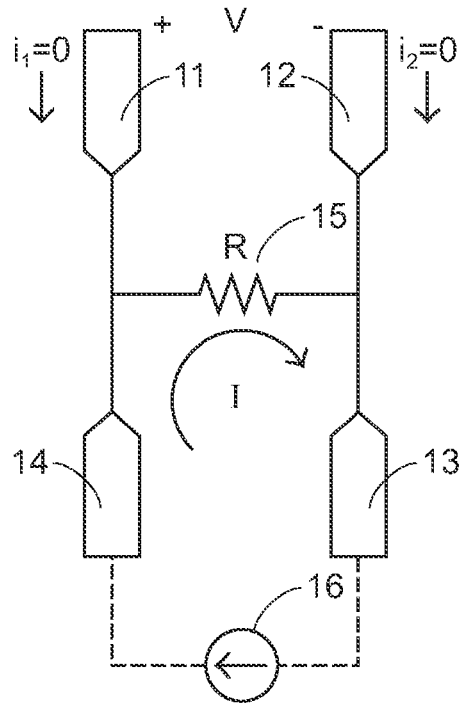
FIG.1 PRIOR ART
FIG. 1 is a schematic circuit diagram illustrating Kelvin measurement.
Figure 2A:
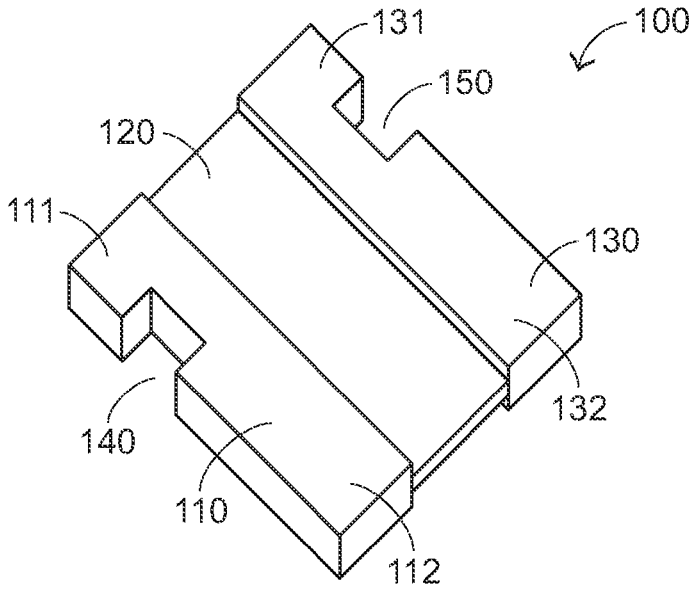
FIG.2A PRIOR ART
FIG. 2A is a schematic diagram illustrating a structure of a current sensing resistor according to prior art.
Figure 2B:
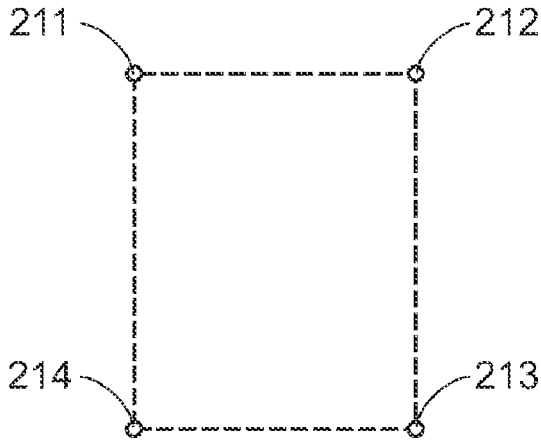
FIG.2B PRIOR ART
FIG. 2B is a schematic diagram illustrating four measurement points used for measuring resistance by a measuring apparatus in a production line of resistors.
Figure 2C:
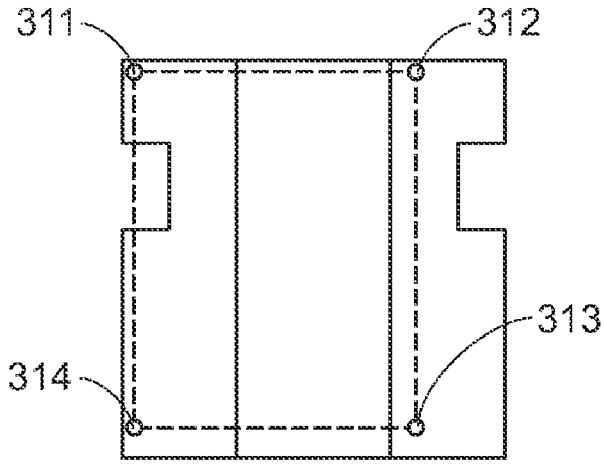
FIG.2C PRIOR ART
FIG. 2C~FIG. 2E are schematic diagrams illustrating possible distributions of the four measurement points on a resistor plate, occurring in prior art.
Figure 2D:
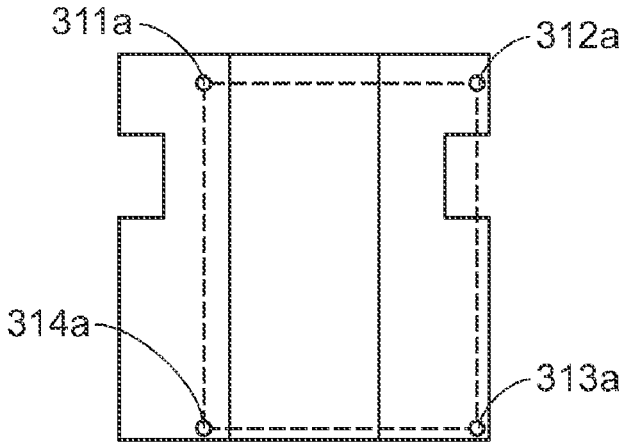
FIG.2D PRIOR ART
Figure 2E:
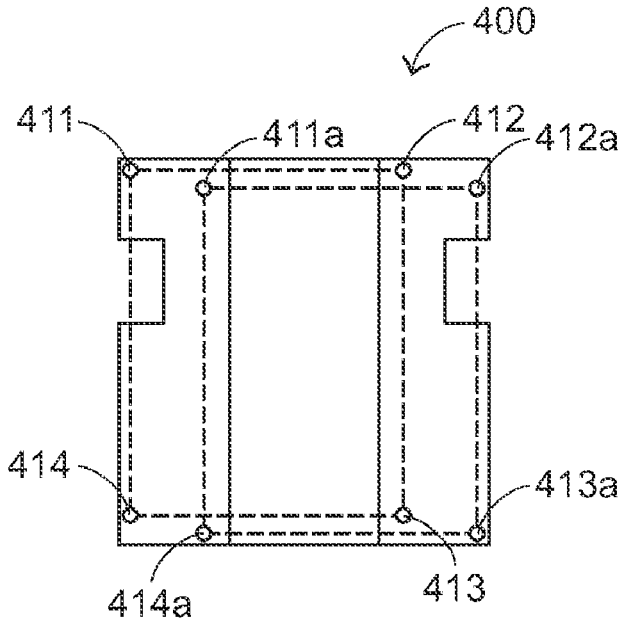
FIG.2E PRIOR ART
Figure 3A:
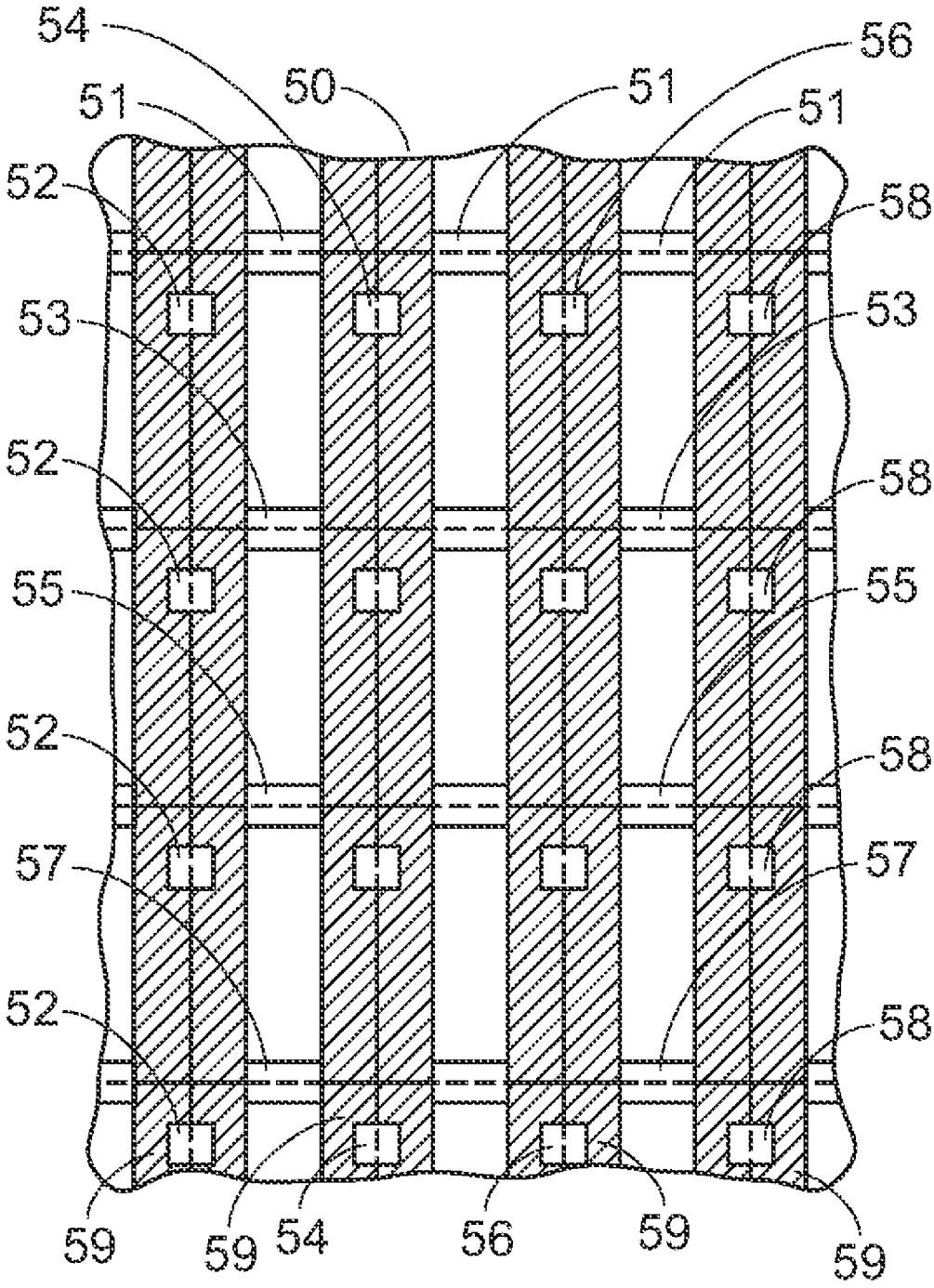
FIG. 3A is a schematic diagram illustrating a top view of a resistor array to be divided into a plurality of current sensing resistors according to an embodiment of the present invention.

Please refer to FIG. 3A, which illustrates a resistor array to be divided into a plurality of resistor units. The resistor array is advantageous for mass production of resistor devices of the present invention. The manufacturing method of the resistor array and the resistor units will be described later.

Figure 3B:
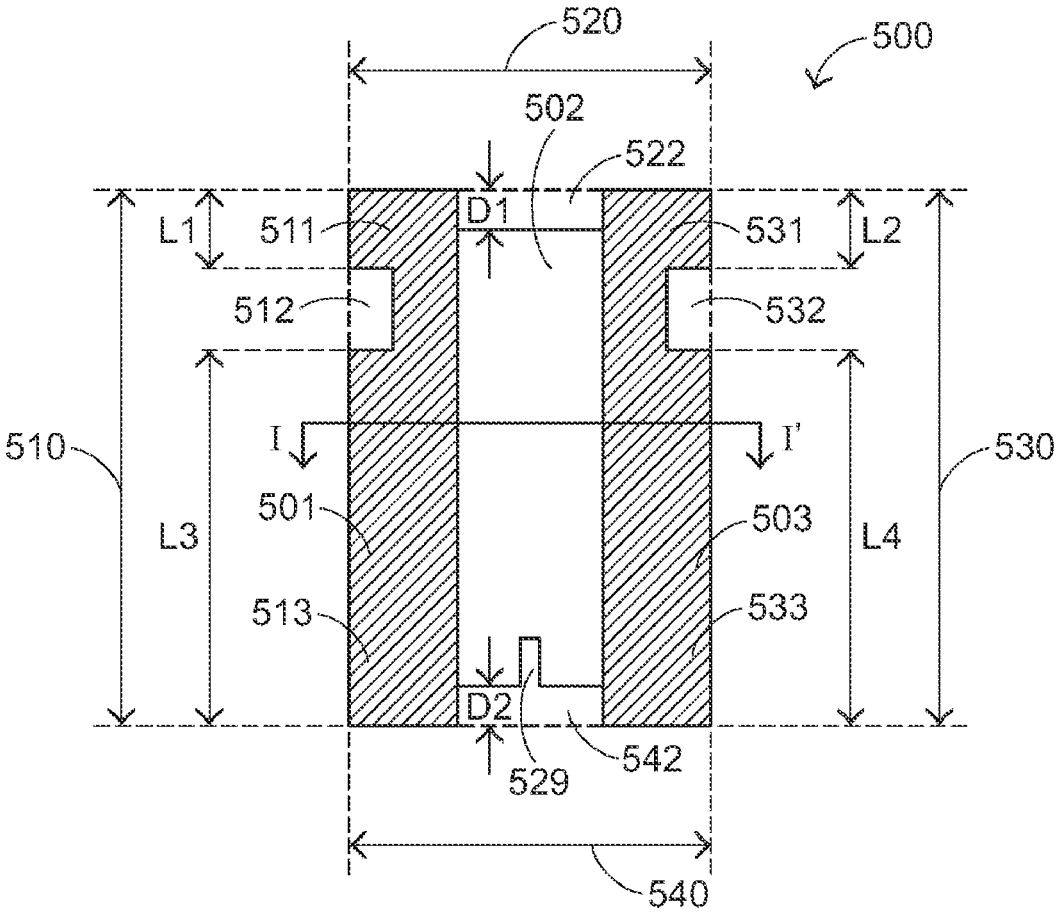
FIG. 3B is a schematic diagram illustrating a top view of a resistor unit divided from the resistor array of FIG. 3A.
Figure 3C:
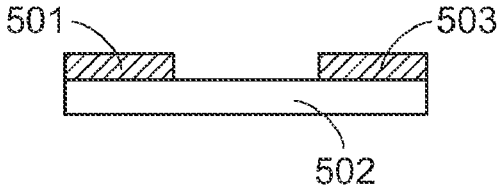
FIG. 3C is a schematic diagram illustrating a cross-sectional view taken along a I-I' line of the resistor unit of FIG. 3B.

FIG. 3B illustrates an individual resistor unit 500 divided from the resistor array of FIG. 3A. FIG. 3C shows a cross-sectional view of the resistor unit 500 along an I-I' line of FIG. 3B. The resistor unit 500 has a first side 510, a second side 520, a third side 530 opposite to the first side 510, and a fourth side 540 opposite to the second side 520, wherein the first side 510 and the third side 530 are perpendicular to and longer than the second side 520 and the fourth side 540 in this embodiment. The resistor unit 500 is constructed with a resistor plate 502 serving as a main body and a first electrode plate 501 and a second electrode plate 503 electrically coupled to the resistor plate 502 at the first side 510 and the third side 530, respectively.

In the resistor unit 500, an aperture 512 is created at the first side 510 so as to divide the first electrode plate 501 into a first preliminary measurement zone 511 and a second preliminary measurement zone 513, wherein the first preliminary measurement zone 511 has the length L1 at the first side 510 less than the length L3 of the second preliminary measurement zone 513 at the same side, and an aperture 532 is created at the third side 530 so as to divide the second electrode plate 503 into a third preliminary measurement zone 531 and a fourth preliminary measurement zone 533, wherein the third preliminary measurement zone 531 has the length L2 at the third side 530 less than the length L4 of the fourth preliminary measurement zone 533 at the same side.

In addition, an aperture 522 is created in the resistor plate 502 between the first electrode plate 501 and the second electrode plate 503 at the second side 520, having a recessed depth D1, and an aperture 542 is created in the resistor plate 502 between the first electrode plate 501 and the second electrode plate 503 at the fourth side 540, having a recessed depth D2. The value of the depth D1 is less than the value of the length L1 and also less than the value of the length L2. Likewise, the value of the depth D2 is less than the value of the length L3 and also less than the value of the length L4.

Figure 4A:
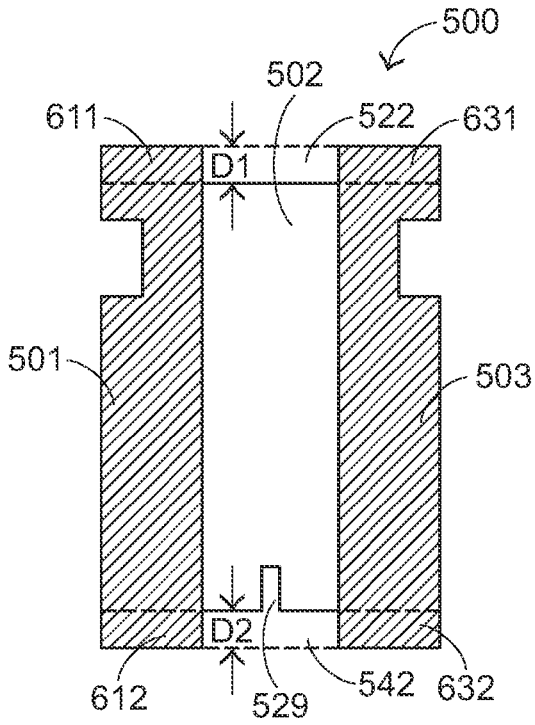
FIG. 4A is a schematic diagram illustrating measurement zones defined on a resistor unit according to an embodiment of the present invention.

The depth D1 of the aperture 522 further confines the first preliminary measurement zone 511 defined by the aperture 512 on the first electrode plate 501 to a first measurement zone 611 and confines the third preliminary measurement zone 531 defined by the aperture 532 on the second electrode plate 503 to a third measurement zone 631, as shown in FIG. 4A. Likewise, the depth D2 of the aperture 542 further confines the second preliminary measurement zone 513 defined by the aperture 512 on the first electrode plate 501 to a second measurement zone 612 and confines the fourth preliminary measurement zone 533 defined by the aperture 532 on the second electrode plate 503 to a fourth measurement zone 632. Then Kelvin measurement is performed by coupling a constant current source to two measurement points respectively in the second and fourth measurement zones 612 and 632, and measuring a voltage difference between two measurement points respectively in the first and third measurement zones 611 and 631.

Figure 4B:
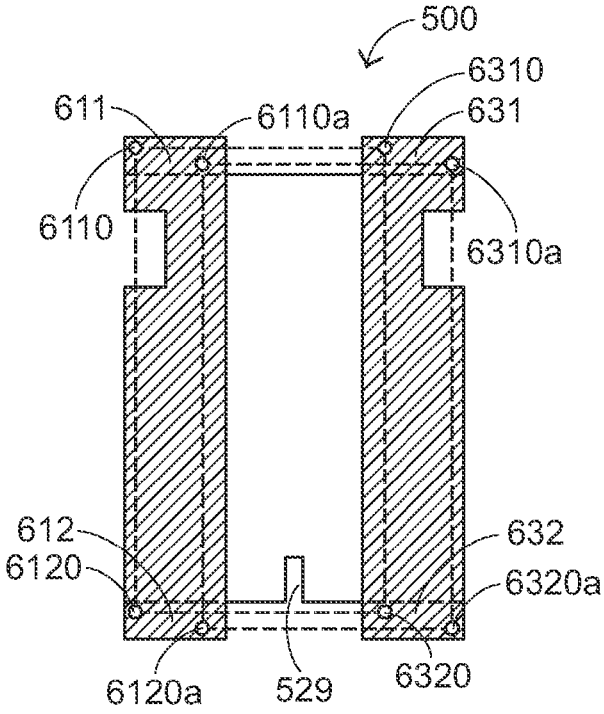
FIG. 4B is a schematic diagram illustrating possible distributions of the four measurement points on the resistor unit of the embodiment of FIG. 4A.

By defining the first, second, third and fourth measurement zones, Kelvin measurement can be performed with minimized deviations for the reasons described hereinafter with reference to FIG. 4B, in which two sets of possible measuring points 6110, 6120, 6310, 6320 and 6110*a*, 6120*a* 6310*a*, 6320*a* are exemplified. Since the shifts between the two sets of possible measuring points are confined within the measurement zones 611, 612, 631 and 632, deviation of the measured resistance of the resistor unit 500 can be well controlled so as to enhance the measurement precision.

The measured resistance is compared with a preset ideal value of resistance and adjusted if necessary. The resistance of the resistor unit 500 can be fine-tuned with a slit 529 as described below when the measurement shows the resistance of the resistor unit 500 is not close enough to the preset value. Preferably, the slit 529 is created into the bottom of the aperture 542 by way of laser cutting. Since the resistance of the resistor unit 500 will vary with the length of the slit 529, the size of the slit 529 is determined according to the resistance level to be reached. The positions and sizes of the apertures should be well selected so as to reach a target value of resistance with minimized measurement and adjustment repetitions.

In order to obtain the resistor units 500 as described above, a manufacturing method is provided with reference to FIG. 3A. As shown, rows of apertures 51, 53, 55, 57 and columns of apertures 52, 54, 56, 58 are created in a sheet of the resistor plate 50 by way of etching, punching or any other suitable method. Then an electrode material is applied onto one or more surfaces of the resistor plate to form a plurality of columns of electrode plates 59 surrounding the columns of apertures. The electrode plates 59 and the resistor plate 50 form a stacked structure. The stacked structure is then divided into the resistor units 500 along the columns of apertures 52, 54, 56, 58 and the rows of apertures 51, 53, 55, 57 in a manner that the columns of apertures 52, 54, 56, 58 are divided into the first and third apertures 512 and 532 of the resistor units 500, and the rows of apertures 51, 53, 55, 57 are divided into the second and fourth apertures 522 and 542. Meanwhile, each column of electrode plate 59 is divided into the first electrode plates 501 incorporating the first apertures 512 and the second electrode plates 503 incorporating the third apertures 532.

For having the first and third sides 510, 530 of the resistor units 500 longer than the second and fourth sides 520, 540, a distance between adjacent rows of apertures 51, 53, 55, 57 is made greater than a distance between adjacent columns of apertures 52, 54, 56, 58, as shown in FIG. 3A.

For making the length L1 shown in FIG. 3B less than the length L3 and making the length L2 less than the length L4, as described previously, each aperture, e.g. 52, present between two adjacent rows of apertures, e.g. 51 and 53, is arranged closer to one row, e.g. 51, than the other, e.g. 53, as shown in FIG. 3A.

For making the value of the depth D1 shown in FIG. 3B less than the value of the length L1 and the value of the length L2 and making the value of the depth D2 less than the value of the length L3 and the value of the length L4, as described previously, each aperture, e.g. 52, present between two adjacent rows of apertures, e.g. 51 and 53, is so arranged that an upper edge of the aperture 52 is lower than lower edges of the upper row of apertures 51 and a lower edge of the aperture 52 is higher than upper edges of the lower row of apertures 53, as shown in FIG. 3A.

By way of properly selecting positions of the apertures in the resistor plate, the resistor units 500 can be readily obtained after the dividing operation. The current sensing resistors formed in the following embodiments may also be produced involving the manufacturing method as described above.

Figure 5A:
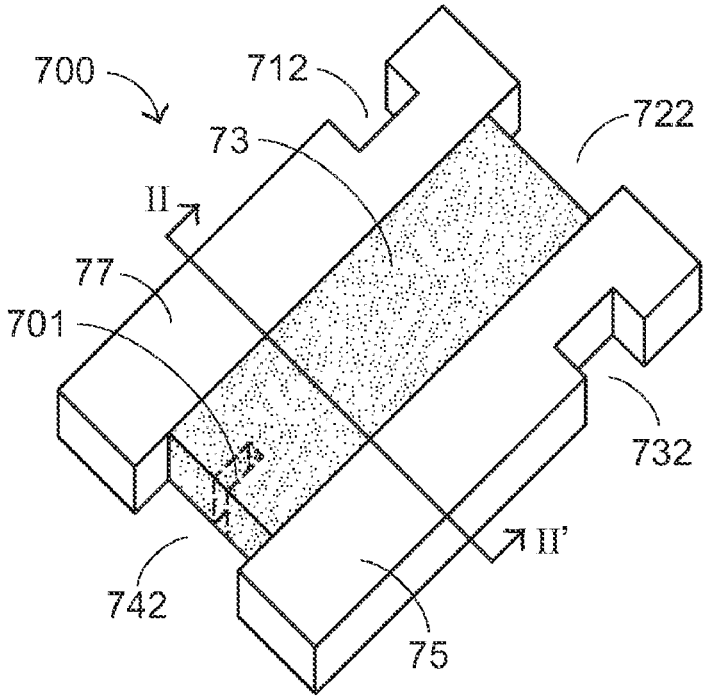
FIG. 5A is a schematic diagram illustrating a perspective view of a resistor device according to an embodiment of the present invention.
Figure 5B:
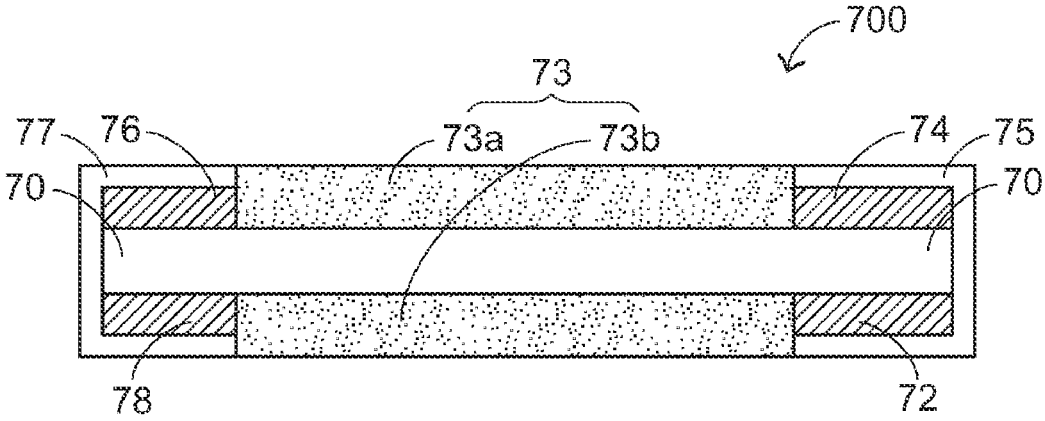
FIG. 5B is a schematic diagram illustrating a cross-sectional view taken along a II-II' line of the resistor device of FIG. 5A.

Please refer to FIG. 5A, which illustrates a current sensing resistor 700 according to an embodiment of the present invention. FIG. 5B is a cross-sectional view taken along a line II-II' of FIG. 5A. In this embodiment, the manufacturing of the current sensing resistor 700 involves an electroplating process. The structure of the current sensing resistor 700 includes a resistor plate 70, electrode plates 72, 74, 76 and 78 covering both end portions of the resistor plate 70, a protective layer 73 covering the portion of the resistor plate 70 uncovered by the electrode plates 72, 74, 76 and 78, and soldering layers 75 covering the electrode plates 72, 74, 76 and 78. In addition, a first aperture 712, a second aperture 722, a third aperture 732 and a fourth aperture 742 are arranged at four sides of the current sensing resistor 700 for positioning the resistor, and a slit 701 is disposed inside the fourth aperture 742 for fine-tuning resistance.

In an example, the current sensing resistor 700 is manufactured with the following procedures. The resistor plate 70 can be made of a resistive material, e.g. an alloy or a compound of manganese-copper, nickel-copper or nickel-phosphorus. Four apertures are created on four sides of the resistor plate by way of etching or punching. Perform an electroplating process on the resistor plate 70 with the four apertures so as to form the electrode plates 72, 74, 76 and 78 covering both end portions of the resistor plate 70 as a stacked structure. Then another electroplating is performed to form the soldering layer 75 covering the electrode plates 72 and 74 and the soldering layer 77 covering the electrode plates 76 and 78. In this example, the soldering layers 75 and 77 may have a stacked structure of copper, nickel and tin layers. Alternatively, the soldering layers 75 and 77 can be made of, but are not limited to the material of, silver, platinum, solder, etc., depending on practical requirements. Then epoxy resin is applied to the exposed portion of the resistor plate 70 to form the protective layers 73*a* and 73*b*. The protective layer 73 is not only used for protection but also functions for strengthening the structure. Before the formation of the protective layers 73*a* and 73*b*, the slit 701 can be created by laser cutting. It is to be noted that soldering layers 75 and 77 and the protective layers 73*a* and 73*b* are desirable but not essential to the implementation of the present invention.

Figure 6A:
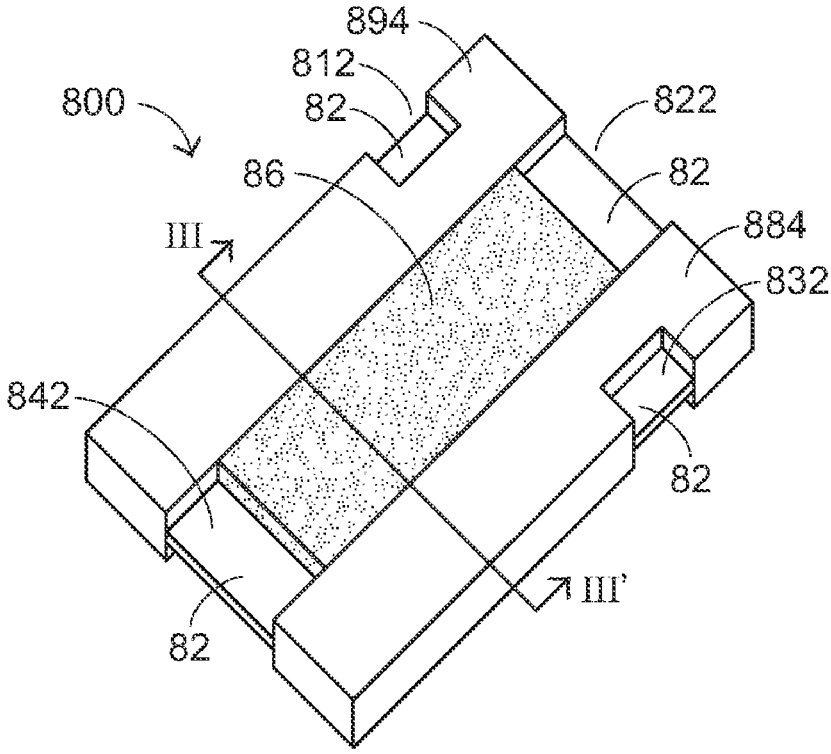
FIG. 6A is a schematic diagram illustrating a perspective view of a resistor device according to another embodiment of the present invention.
Figure 6B:
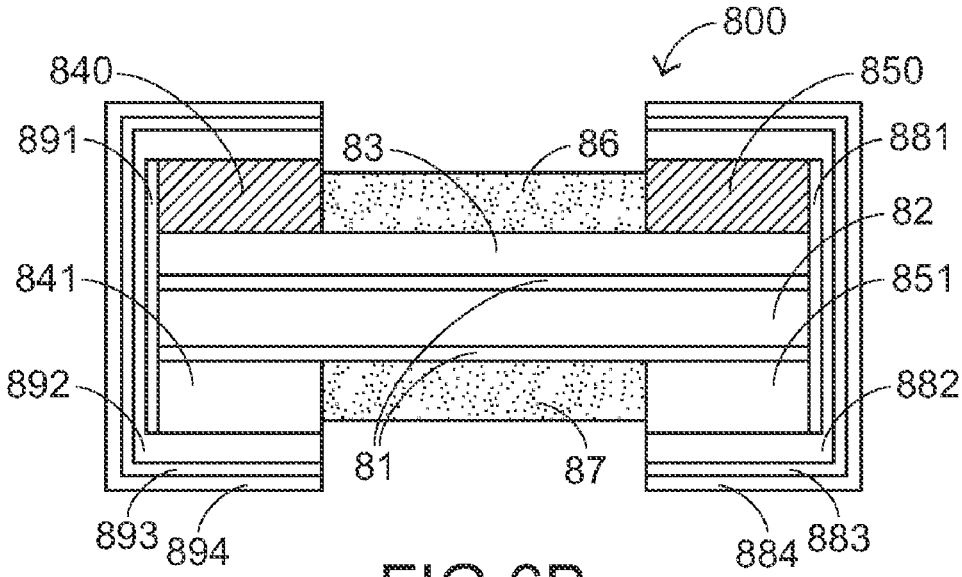
FIG. 6B is a schematic diagram illustrating a cross-sectional view taken along a III-III' line of the resistor device of FIG. 6A.

Please refer to FIG. 6A, which illustrates a current sensing resistor 800 according to another embodiment of the present invention. FIG. 6B is a cross-sectional view taken along a line III-III' of FIG. 6A. In this embodiment, the manufacturing of the current sensing resistor 800 involves a laminating process, and the current sensing resistor 800 includes a carrier plate 82 supporting a resistor plate 83 and electrode plates 840 and 850. For example, the carrier plate 82 is made of ceramic. The capability of the ceramic carrier plate 82 of supporting the resistor plate 83 makes the modification of the resistor plate 83 for resistance adjustment less difficult.

In the manufacturing process of the resistor 800, the ceramic carrier 82 and the resistor plate 83 are laminated with an adhesive layer 81. The resistor plate 83 can be made of a resistive material, e.g. an alloy or a compound of manganese-copper, nickel-copper or nickel-phosphorus, and formed by thick film printing. The adhesive layer 81 may be a heat-dissipating film made of a mixture of epoxy resin and glass fiber, which functions for adhesion between the ceramic carrier 82 and the resistor plate 83 and heat conduction. Afterwards, four apertures 812, 822, 832 and 842 are provided at four sides of the laminated adhesive layer 81 and the resistor plate 83 by way of etching with corresponding parts of the ceramic carrier 82 exposed. As described previously, the four apertures 812, 822, 832 and 842 in the resistor plate 83 facilitates positioning of measurement zones, thereby enhancing precision of subsequent resistance measurement and resistor modification. Then conductive electrode plates 840 and 850 overlies opposite end portions of the resistor plate 83 by way of electroplating, laminating, soldering or any other proper means. The electrode plates 840 and 850 can be made of copper, silver or any other suitable conductive material.

Preferably, a metal layer, e.g. a copper layer, is laminated onto one side of the ceramic carrier 82 with another adhesive layer 81 at the same time when the resistor plate 83 is laminated onto the opposite side of the ceramic carrier 82 with the adhesive layer 81. The metal layer is further etched or punched to form metal plates 841 and 851 distributed on end portions of the ceramic carrier 82, respectively. The metal plates 841 and 851 functions for heat dissipation from the resistor 800 and preventing the structure from warping.

Kelvin measurement is then performed for the resulting structure to measure resistance of the resistor 800. If the measured result shows that it is necessary to fine tune the resistance, laser-cutting the resistor plate 83 to create a slit as described previously, which has a proper size leading to the target value or range of resistance. Afterwards, a first protective layer 86 is formed covering the resistor plate 83 between the electrode plates 840 and 850 for protecting the resistor plate 83 from contamination and/or oxidation. Preferably, a second protective layer 87 is formed covering the adhesive layer 81 between the metal plates 841 and 851 for further strengthening the resistor structure. The protective layers 86 and 87 are made of an insulating material, e.g. epoxy resin, and applied by way of for example printing. It is noted that the protective layers 86 and 87 can be attached onto the adhesive layer 81 when the above-described laminating process is adopted. Alternatively, the protective layers 86 and 87 can be directly forms on the ceramic carrier 82 once an electroplating process without adhesive layers is adopted.

Afterwards, lateral electrodes 881 and 891 are formed beside the stacked structure of the resistor plate 83, the adhesive layer 81 and the ceramic carrier 82 by barrel plating. The lateral electrode 881 are electrically connected to the electrode plate 850 and the metal plate 851, and the lateral electrodes 891 are electrically connected to the electrode plate 840 and the metal plate 841. Preferably, a soldering layer is applied to the resulting structure, covering the electrode 850, the metal plate 851 and the lateral electrode 881, and a soldering layer 892 is applied to cover the electrode 840, the metal plate 841 and the lateral electrode 891 for improving adhesion of the lateral electrodes 881 and 891 to the electrode plates and the metal plates and enhancing soldering strength to a circuit board (not shown). Each of the soldering layers, for example, may be a multi-layer structure of copper 882, 892, nickel 883, 893 and tin 884, 894, formed by electroplating or sputtering, etc.

It can be seen from the above embodiments that apertures can be provided by etching or punching to precisely define measurement zones without changing or complicating the manufacturing process of the micro-resistor. Furthermore, resistance of the resistor can be fine-tuned by simply modifying the configuration of the resistor plate. The stacked structure further strengthens the resistor.

While the invention has been described in terms of what is presently considered to be the most practical and preferred embodiments, it is to be understood that the invention needs not to be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A resistor device, comprising:

a resistor plate having a first aperture, a second aperture, a third aperture and a fourth aperture respectively arranged on a first side, a second side, a third side and a fourth side thereof;

a first electrode plate coupled to the first side of the resistor plate and including a first measurement zone and a second measurement zone disposed at opposite sides of the first aperture; and a second electrode plate coupled to the third side of the resistor plate and including a third measurement zone and a fourth measurement zone disposed at opposite sides of the third aperture;

wherein the first measurement zone and the third measurement zone are disposed at opposite sides of the second aperture, and the second measurement zone and the fourth measurement zone are disposed at opposite sides of the fourth aperture.

2. The resistor device according to claim 1 wherein the third side is opposite to the first side and has the same first length as the first side, and the fourth side is opposite to the second side and has the same second length as the second side, wherein the second length is less than the first length.

3. The resistor device according to claim 1 wherein the first measurement zone is defined by the second aperture together with the first aperture, the second measurement zone is defined by the fourth aperture together with the first aperture, the third measurement zone is defined by the second aperture together with the third aperture, and the fourth measurement zone is defined by the fourth aperture together with the third aperture.

4. The resistor device according to claim 3 wherein a first distance from the first aperture to the second side is less than a second distance from the first aperture to the fourth side, and a third distance from the third aperture to the second side is less than a fourth distance from the second aperture to the fourth side.

5. The resistor device according to claim 4 wherein a depth of the second aperture from the second side is less than the first distance and the third distance, and a depth of the fourth aperture from the fourth side is less than the second distance and the fourth distance.

6. The resistor device according to claim 1 wherein the first electrode plate is electrically coupled to upper and lower surfaces of the resistor plate at the first side, and the second electrode plate is electrically coupled to upper and lower surfaces of the resistor plate at the third side.

7. The resistor device according to claim 1 wherein the first electrode plate is coupled to the first side of the resistor plate to form a stacked structure by way of electroplating, soldering or laminating, and the second electrode plate is coupled to the third side of the resistor plate to form a stacked structure by way of electroplating, soldering or laminating.

8. The resistor device according to claim 1 further comprising a protective layer covering a portion of the resistor plate exposed from the first and second electrode plates.

9. The resistor device according to claim 1 wherein the resistor plate further has a slit inside the fourth aperture for fine-tuning resistance of the resistor plate.

10. The resistor device according to claim 1 further comprising a carrier plate disposed under the resistor plate and exposed from the first, second, third and fourth apertures.

11. The resistor device according to claim 10 further comprising a protective layer covering a portion of the resistor plate exposed from the first and second electrode plates.

12. The resistor device according to claim 10 further comprising an adhesive layer clamped between the carrier plate and the resistor plate.

13. The resistor device according to claim 10 further comprising a metal plate disposed under the carrier plate, and an adhesive layer clamped between the carrier plate and the metal plate.

14. A manufacturing method of a resistor device, comprising:

providing a resistor plate;

creating a plurality of columns of apertures and a plurality of rows of apertures in the resistor plate;

applying an electrode material onto the resistor plate to form a stacked structure; and dividing the stacked structure into a plurality of resistor units along the columns of apertures and the rows of apertures, each resistor unit having a first aperture, a second aperture, a third aperture and a fourth aperture on a first side, a second side, a third side and a fourth side thereof, respectively, for defining four measurement zones in the resistor unit;

wherein the columns of apertures are divided into the first and third apertures, and the rows of apertures are divided into the second and fourth apertures.

15. The manufacturing method according to claim 14 wherein the electrode material is applied onto one or more surfaces of the resistor plate to form a plurality of columns of electrode plates surrounding the columns of apertures, and each column of electrode plate is divided into first electrode plates incorporating the first apertures and second electrode plates incorporating the third apertures in the dividing step.

16. The manufacturing method according to claim 14 wherein a distance between adjacent rows of apertures is greater than a distance between adjacent columns of apertures.

17. The manufacturing method according to claim 14 wherein each aperture in each column is present between two adjacent rows of apertures and closer to one row than the other.

18. The manufacturing method according to claim 14 wherein each aperture in each column is present between two adjacent upper and lower rows of apertures, wherein an upper edge of the aperture in the column is lower than lower edges of the upper row of apertures and a lower edge of the aperture in the column is higher than upper edges of the lower row of apertures.

19. The manufacturing method according to claim 14 further comprising:

providing a carrier plate coupled to the resistor plate;

wherein the carrier plate are exposed from the first aperture, second aperture, third aperture and fourth aperture.

20. The manufacturing method according to claim 14 wherein the columns and rows of apertures are created by etching or punching.

21. The manufacturing method according to claim 14 further comprising:

optionally creating a slit inside the fourth aperture of the resistor unit for tuning resistance of the resistor unit;

wherein a size of the slit is determined according to a resistance level to be reached.

* * * * *